United States Patent [19]

Grimes

[11] 4,391,428

[45] Jul. 5, 1983

[54] LANCE-TYPE FIXTURE SUPPORT AND METHOD OF USE

[75] Inventor: Fred K. Grimes, Tallahassee, Fla.

[73] Assignee: Lance Austin Enterprises, Inc., Tallahassee, Fla.

[21] Appl. No.: 344,008

[22] Filed: Jan. 29, 1982

Related U.S. Application Data

[63] Continuation-in-part of Ser. No. 321,630, Nov. 16, 1981, abandoned.

[51] Int. Cl.[3] ..... F16M 13/00

[52] U.S. Cl. ..... 248/546; 248/27.1; 248/57; 248/DIG. 6

[58] Field of Search ..... 248/27.1, 57, 546, DIG. 6; 52/28, 39; 362/147, 404, 406

[56] References Cited

U.S. PATENT DOCUMENTS

| | | | |
|---|---|---|---|
| 1,856,356 | 5/1932 | Owen | 174/63 |
| 1,892,286 | 12/1932 | Nyberg | 174/63 |
| 1,927,515 | 9/1933 | Eastman | 248/343 |
| 2,140,861 | 12/1938 | Steketee . | |
| 2,461,794 | 2/1949 | Williams | 248/57 |
| 2,670,919 | 3/1954 | Esoldi | 248/57 X |
| 2,701,115 | 2/1955 | Rachlin | 248/546 X |
| 2,713,983 | 7/1955 | Kay | 248/57 |
| 2,770,436 | 11/1956 | Linhardt | 248/57 |
| 2,933,241 | 4/1960 | Braskamp | 248/27.1 |
| 2,963,253 | 12/1960 | Maier et al. | 174/63 X |
| 2,964,279 | 12/1960 | Galloway | 248/546 X |
| 3,132,578 | 5/1964 | Sherron | 52/28 X |
| 3,163,386 | 12/1964 | Collins | 248/57 X |
| 3,425,655 | 2/1969 | Cogdill | 248/546 X |
| 3,499,359 | 3/1970 | Yrjanainen | 248/546 X |
| 3,518,421 | 6/1970 | Cogdill | 248/57 |
| 4,293,895 | 10/1981 | Kristofek | 362/147 |
| 4,306,702 | 12/1981 | Martin | 248/546 |
| 4,325,528 | 4/1982 | Martin | 248/546 X |

FOREIGN PATENT DOCUMENTS

| | | | |
|---|---|---|---|
| 1578757 | 11/1980 | United Kingdom | 248/27.1 |

*Primary Examiner*—William H. Schultz

*Attorney, Agent, or Firm*—Schuyler, Banner, Birch, McKie and Beckett

[57] ABSTRACT

A support for a ceiling fan or other fixture has a pair of slidably interconnected, pointed lances adapted to be driven into engagement with spaced structural members. A tool-strikable striking element is adapted to be coupled to each lance at a selected location along the length thereof. The support is adapted to be installed through a small hole in a preexisting ceiling or wall.

17 Claims, 6 Drawing Figures

LANCE-TYPE FIXTURE SUPPORT AND METHOD OF USE

This application is a continuation-in-part of copending application Ser. No. 321,630, filed Nov. 16, 1981, abandoned.

BACKGROUND OF THE INVENTION

This invention relates to supports designed to support a fixture or other object between a pair of spaced structural members, such as substantially parallel studs, beams, joists or rafters, whether the members are exposed or concealed behind a wall member, such as wallboard, paneling or plaster. This invention is particularly well suited for supporting fixtures such as ceiling fans from the ceiling of a structure such as a house.

The ever increasing cost of energy has forced the public to be significantly more energy conscious. Obviously, one method for reducing the heating and cooling cost of a structure such as a house is to decrease the heating or cooling load necessary to maintain a comfortable living environment in the house. One technique is to circulate the air in each room. In the summer months, the circulating airflow has a cooling effect to the occupants of the house, even though the ambient temperature of the air remains the same. In the winter months, it is desirous to circulate the air to prevent the hot air from accumulating Probably the most widely used device for creating the airflows described above is the ceiling fan, the majority of which are reversible to force the hot air from the ceiling toward the floor during the winter months, and to force the cold air accumulating at the floor toward the ceiling in the summer months. Since some of the fans weight as much as 65 pounds, it is imperative that a solid support be provided for supporting the ceiling fan. Heretofore, virtually all of the supports constituted some form of custom-made wooden structure which was nailed to the joists of the ceiling, assuming the ceiling was accessible through the attic of the house. In some houses, the ceiling is not accessible, in which case the consumer must make a large hole in the plaster or chipboard of the ceiling to permit access to the joists for installation of the custom-made support assembly. The homeowner must then patch the hole thus formed in the ceiling. From the foregoing, it should be appreciated that many homeowners are precluded from installing ceiling fans in their homes because of the attendant difficulties and expense.

SUMMARY OF THE INVENTION

It is therefore an object of this invention to provide an apparatus and method which overcomes the aforementioned drawbacks and inadequacies associated with prior art installations of fixtures such as ceiling fans.

Another object of this invention is to provide a support for a fixture which can be installed behind a wall member of a structure, such as the wallboard, paneling or plaster of a wall or ceiling, without the need for gaining unlimited access to the space therebehind.

Another object of this invention is to provide a support which can be installed through a small opening in the wall member, thus obviating the need to patch a much larger opening after installation.

Another object of this invention is to provide a support which is adjustable to permit installation behind wall members supported on differently spaced joists, rafters, beams or studs.

Another object of this invention is to provide a support which can be installed by a homeowner without the need for special tools or expertise.

These and other objects of the invention are accomplished by providing a support for mounting a fixture between a pair of spaced structural members comprising a pair of elongated lances slidably interconnected for relative longitudinal sliding movement. Each of the lances is shorter than the distance between the structural members. Together the lances form an adjustable length support adapted to span the space between the members. Member engaging means is provided at the distal end of each lance for engaging the structural member and supporting the lance thereon when the lances are driven longitudinally in opposite directions against the structural members. Striking element coupling means are provided on each of the lances for coupling a tool strikable striking element to the lance at a fixed location intermediate its ends, whereby the member engaging means are driven into engagement with the structural members when the striking element is coupled to each of the lances and struck with a tool.

The invention also encompasses a method of installing the above described support behind a wall member, such as the wallboard, paneling or plaster of a wall or ceiling. The method involves inserting the interconnected lances through a small hole in the wall member, orienting the lances transversely of the structural members, and extending the lances into abutment with the structural members. A striking tool is then inserted through the hole and is used to strike striking means (associated with each lance intermediate the ends thereof) in opposite longitudinal directions to force the lances into engagement with the structural members.

The support according to the invention can be used to support a fixture on various types of structural members, such as wall studs, beams, ceiling joists or roof rafters, in any desired orientation. The invention will find particularly useful application in the mounting of currently popular ceiling fans from preexisting ceilings. In this regard, the support can be easily installed above the ceiling through a small diameter access hole, without having to tear out a large portion of the ceiling to gain access to the joists. The striking elements can be adjustably positioned along the lances, so that a hammer or other striking tool to be conveniently inserted through the hole in the ceiling and driven against the striking elements. Once the lances have been driven into the joists, a suitable clamping device, such as a bolt-on electrical outlet box, may be bolted to the lances to securely fasten them together and provide a stable platform from which to hang a ceiling fan or other fixture.

BRIEF DESCRIPTION OF THE DRAWINGS

The novel features of the invention are set out with particularity in the appended claims, but the invention will be understood more fully and clearly from the following detailed description of a preferred embodiment of the invention taken in conjunction with the accompanying drawings, in which:

DETAILED DESCRIPTION OF A PREFERRED EMBODIMENT

Figure 4:
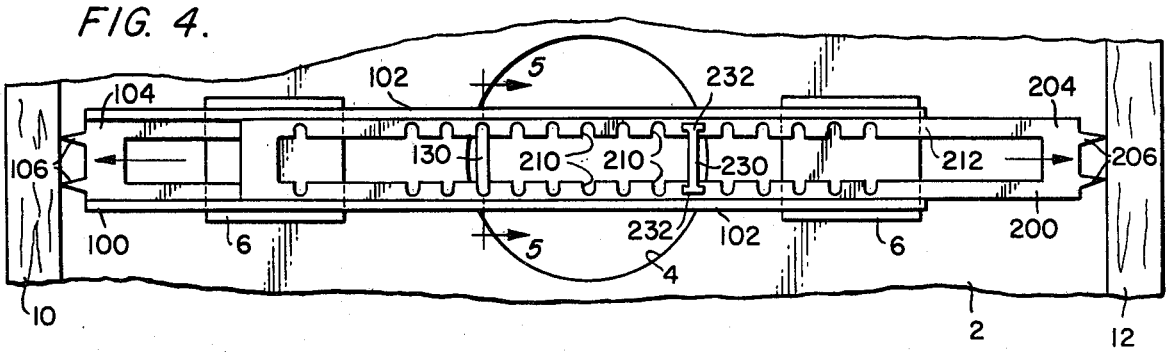
FIG. 4 is a top plan view of the support located above the ceiling just before the lances are driven into the joists.
Figure 5:
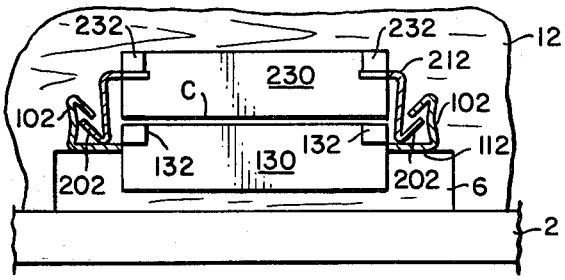
FIG. 5 is a cross-sectional view taken along line 5—5 of FIG. 4.
Figure 6:
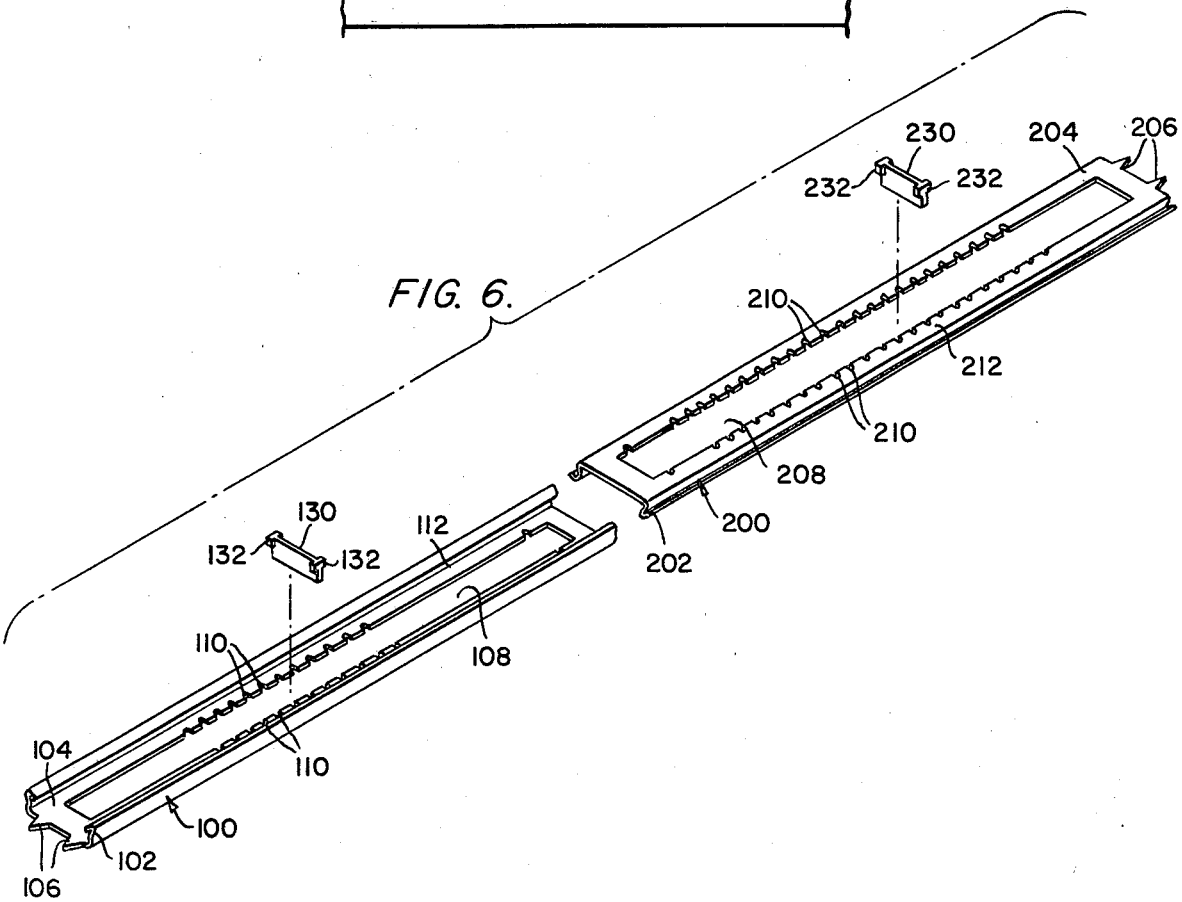
FIG. 6 is an exploded view of the support according to the invention.

Referring initially to FIGS. 4, 5 and 6, the support according to the invention comprises a pair of slidably interconnected lances 100, 200 fabricated of steel or other suitable rigid material. The sides of lower lance 100 are bent upwardly and inwardly to form channels 102 which slidably receive and closely retain mating outwardly turned edges 202 of upper lance 200. The distal end 104 of lance 100 is provided with a pair of longitudinally directed point penetrating members in the form of teeth or prongs 106 which are adapted to be embedded in a structural support, such as a joist, when lance 100 is driven in a longitudinal direction. Similarly, distal end 204 of lance 200 is provided with pointed penetrating members in the form of teeth or prongs 206. The central portions of lances 100, 200 are provided with elongated apertures or slots 108, 208, respectively. These slots may be formed by punching or cutting out material from the centers of the lances, or by fabricating each lance as a composite structure consisting of side rails welded to end pieces.

Lance 100 is adapted to be coupled to a plate-like, tool-strikable element 130. Coupling is accomplished by pairs of opposed notches 110 on the inner edges of slot 108. Element 130 has laterally projecting shoulders or ears 132 which support the element on the lower flanges 112 of the side rails of lance 100 when element 130 is dropped into position in a selected pair of notches 110. Similarly, slot 208 is provided with pairs of opposed notches 210. Tool-strikable element 230 is provided with laterally projecting shoulders or ears 232 which support it on the upper flange 212 of the side rails of lance 200. Elements 130, 230 and lances 100, 200 are dimensioned such that there is a vertical clearance C between elements 130, 230 when they are coupled to lances 100, 200 (FIG. 5). This permits the lances to be slid freely relative to one another as described below. Each lance is shorter than the distance between the two joists to which the support is to be attached, as described below.

Figure 1:
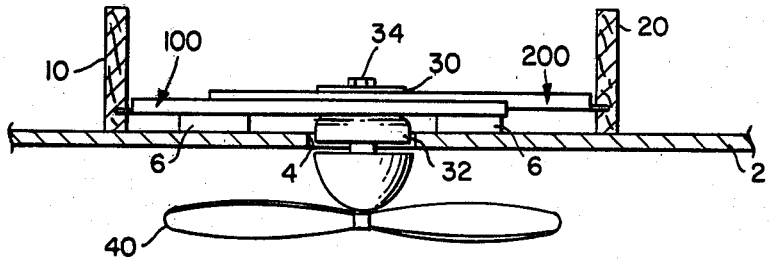
FIG. 1 is a cross-sectional view through the ceiling and two joists of a house showing the support of the invention in place supporting a ceiling fan.
Figure 2:
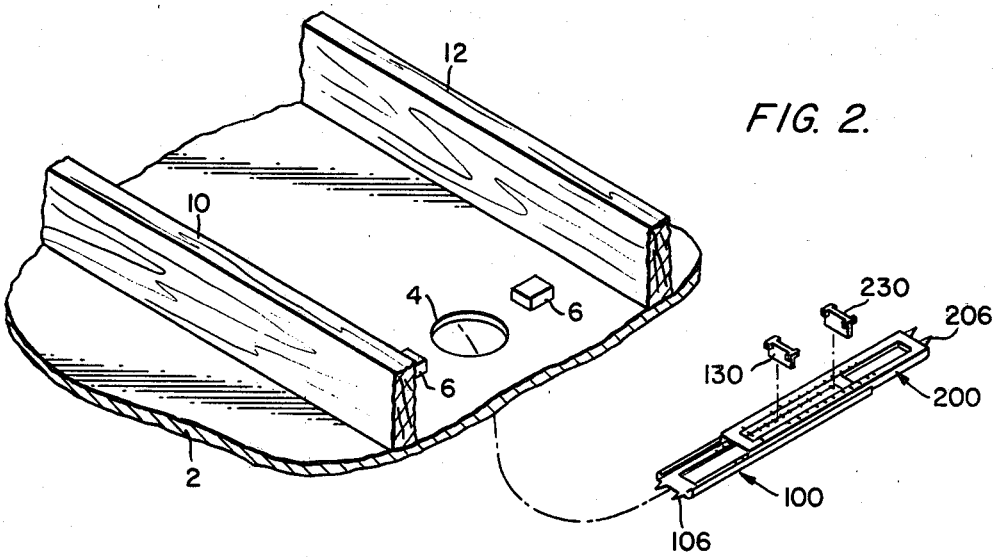
FIG. 2 is a perspective view of the ceiling and two joists of a house illustrating the manner of insertion of the support through a hole in the ceiling.
Figure 3:
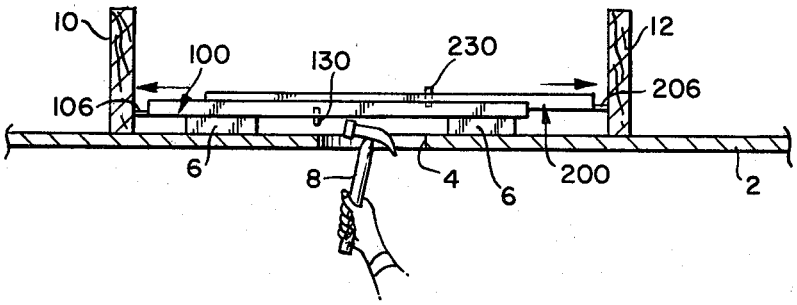
FIG. 3 is a cross-sectional view similar to FIG. 1 illustrating the manner of installation of the support.

FIGS. 1, 2 and 3 illustrate how the support of the invention is installed above an existing, joist-supported ceiling. Ceiling 2 is supported on the underside of substantially parallel joists 10, 20. A hole 4 in ceiling 2 provides access to the space above the ceiling. Hole 4 may be a preexisting hole which formerly accommodated an electrical outlet box for an ordinary light fixture. If the ceiling fan or other fixture is to be installed in a new location, hole 4 may be a newly cut hole.

In installing the support of the invention, lances 100, 200 are first telescoped completely together. The lances are then inserted upwardly above the ceiling through hole 4 while oriented parallel to joists 10, 20. Once above the ceiling, the support is turned so that it is oriented transversly of joists 10, 20. The support is then manually extended by sliding lances 100, 200 outwardly relative to one another until prongs 106, 206 come into contact with their respective joists 10, 20. The outline of hole 4 is then marked on the lances with a pencil or other marking device. The support is then collapsed, turned parallel to the joists and withdrawn from the hole.

At this point element 130 is dropped into the pair of notches 110 located nearest the left hand mark (as seen in FIG. 4) on lance 100. Similarly, element 230 is dropped into the pair of notches 210 located nearest the right hand mark on lance 200. The lances are then collapsed, reinserted through the hole above the ceiling, turned perpendicular to the joists, and expanded until prongs, 106, 206 are again in contact with the joists. Spacers 6 are inserted through hole 4 and placed beneath the lances on either side of hole 4. Spacers 6 may be made of scrap wood or any other suitable material, and serve to locate prongs 106, 206 at a small distance above the bottoms of joists 10, 20 so that the prongs will have a sufficient thickness of joist material in which to be embedded.

Once spacers 6 are in place and the lances 100, 200 are properly oriented and extended, a hammer 8 or other striking tool is inserted through hole 4 and driven against element 130. The impact is transmitted to the transverse edges of notches 110, thereby driving lance 100 forwardly and prongs 106 into joist 10. Hammer 8 is then turned in the opposite direction and inserted upwardly through slots 108, 208, whereupon it is driven against element 230 to drive prongs 206 into engagement with joist 20. Sufficient space is provided for the backswing of hammer 8 because elements 130, 230 are located near the edge of hole 4. With the lances firmly engaged with the joists, a suitable clamping device or fastener is installed to rigidly connect lances 100, 200 together to prevent them from being worked loose and disengaging from joists 10, 12. Such a fastener may comprise, for example, an apertured plate 30, an outlet box 32, a bolt 34 and a washer and nut (not shown) within outlet box 32 engageable with bolt 34. A fan 40 or other fixture may then be securely hung from outlet box 32.

It will be appreciated that the support of the invention facilitates the rapid, neat and easy installation of any type of fixture on a preexisting ceiling or wall without the need to remove excessive portions of the ceiling or wall, or patch disturbed areas thereafter. It will be apparent to one of ordinary skill in the art that numerous modifications and changes may be made in the structure and method of installation of the invention without departing from the true spirit and scope of the invention, which is defined by the appended claims. For example, it may be possible to install the support by using only one tool-strikable element, which is first coupled to one lance, struck with a hammer, and then removed and coupled to the other lance and struck with the hammer. Any type of striking elements and striking element coupling means may be used. Other modifications will be readily apparent to those skilled in the art.

I claim:

1. A support for mounting a fixture between a pair of spaced structural members comprising:

a pair of elongated lances slidably interconnected for relative longitudinal sliding movement, each of said lances being shorter than the distance between said structural members and together forming an adjustable length support adapted to span the space between said structural members;

member engaging means at the distal end of each of said lances for engaging said structural members and supporting said lances thereon when said lances are independently driven longitudinally in opposite directions against said structural members;

at least one tool-strikable striking element adapted to receive a longitudinally directed blow from a striking tool; and striking element coupling means on each of said lances for coupling said striking element to each lance at a fixed location intermediate the ends thereof to enable said lances to be independently driven in opposite directions when said striking element is coupled to each of said lances independently of the other and is struck with said tool, whereby said member engaging means are independently driven into engagement with said structural members.

2. A support for mounting a fixture between a pair of spaced structural members comprising:

a pair of elongated lances slidably interconnected for relative longitudinal sliding movement, each of said lances being shorter than the distance between said structural members and together forming an adjustable length support adapted to span the space between said members;

member engaging means at the distal end of each of said lances for engaging said structural members and supporting said lances thereon when said lances are driven longitudinally in opposite directions against said structural members;

a central elongated slot on each of said lances adapted to receive a tool-strikable striking element; and a plurality of longitudinally spaced coupling elements on each of said lances adjacent said slot for coupling said striking element to each lance at a selected fixed location intermediate the ends thereof, whereby said member engaging means are driven into engagement with said structural members when said striking element is coupled to each of said lances and is struck with a tool.

3. A support according to claim 2 wherein each of said coupling elements comprises a pair of opposed notches on the longitudinal edges of said slot, said notches being adapted to receive a plate-like striking element.

4. A support for mounting a fixture between a pair of spaced structural members comprising:

a pair of elongated lances slidably interconnected for relative longitudinal sliding movement, each of said lances being shorter than the distance between said structural members and together forming an adjustable length support adapted to span the space between said structural members;

member engaging means at the distal end of each of said lances for engaging said structural members and supporting said lances thereon when said lances are independently driven longitudinally in opposite directions against said structural members; and striking means associated with said lances intermediate the end of each lance and inwardly of side distal ends and noncontiguous with said member engaging means adapted to receive a longitudinally direct blow from a striking tool and drive each of said member engaging means independently of the other into engagement with said structural members.

5. A support according to claim 4 wherein said striking means can be adjustably positioned along the length of each of said lances.

6. A support for mounting a fixture between a pair of spaced structural members comprising:

a pair of elongated lances slidably interconnected for relative longitudinal sliding movement, each of said lances being shorter than the distance between said members and together forming an adjustable length support adapted to span the space between said structural members;

member engaging means at the distal end of each of said lances for engaging said structural members and supporting said lances thereon when said lances are driven longitudinally in opposite directions against said structural members; and adjustable striking means associated with said lances intermediate the ends thereof adapted to receive a longitudinally directed blow from a striking tool and drive said member engaging means into engagement with said structural members, said striking means comprising a tool-strikable striking element and a plurality of longitudinally spaced coupling elements on each of said lances, each of said coupling elements adapted to engage said striking element.

7. A support according to claim 6 wherein said coupling elements comprise notches adapted to receive said striking element.

8. A support according to claim 6 wherein each of said lances has a central elongated slot, said striking element being receivable within said slot.

9. A support according to claim 8 wherein each of said coupling elements comprises a pair of opposed notches on the longitudinal edges of said slot, said striking element is a plate-like element, and said notches are adapted to receive said plate-like striking element.

10. A support according to claim 6 wherein said striking means comprises a single tool-strikable striking element which is alternately engageable with the coupling elements of said lances.

11. A support according to claim 6 wherein said striking means comprises two tool-strikable striking elements which are separately engageable with the coupling elements of separate lances.

12. A support according to claim 7 or 9 wherein said striking element has an outwardly directed projection which engages the lance adjacent said notches to aid in retaining said striking element in said notches.

13. A support for mounting a fixture between a pair of spaced structural members comprising:

a pair of elongated lances slidably interconnected for relative longitudinal sliding movement, each of said lances being shorter than the distance between said structural members and together forming an adjustable length support adapted to span the space between said members;

at least one pointed penetrating member at the distal end of each of said lances for penetrating and engaging said structural members and supporting said lances thereon when said lances are driven longitudinally in opposite directions against said structural members;

an aperture in each of said lances; and a striking element adapted to be received in either of said apertures, abut a transverse edge of the aperture, receive a longitudinally directed blow from a striking tool, and drive the penetrating members into engagement with said structural members, said striking element having a tool-strikable surface, and an outwardly directed projection which engages the lance adjacent the aperture to aid in retaining said striking element in engagement with said aperture.

14. A support according to claim 13 wherein the aperture in one of said lances comprises a central elongated slot and a plurality of longitudinally spaced pairs of opposed notches on the lontitudinal edges of said slot, said striking element engaging a selected pair of opposed notches when engaged with said one lance, and passable through said slot to engage the other lance.

15. A support according to claim 13 wherein the aperture in each lance comprises a central elongated slot and a plurality of longitudinally spaced pairs of opposed notches on the longitudinal edges of said slot, said striking element engaging a selected pair of opposed notches when engaged with one lance, and passable through said slot to engage a selected pair of opposed notches on the other lance.

16. A support according to claim 13, 14 or 15 wherein said outwardly directed projection comprises a shoulder on said striking element.

17. In combination with a pair of spaced structural members and a wall member which is supported on and conceals said structural members, a fixture support adapted to be installed between said structural members through a small hole in said wall member which is located between said structural members, the support comprising:

a pair of elongated lances slidably interconnected for relative longitudinal sliding movement, each of said lances being shorter than the distance between said structural members and together forming an adjustable length support adapted to pass through the hole in the wall member and span the space between said structural members;

member engaging means at the distal end of each of said lances for engaging said structural members and supporting said lances thereon when said lances are independently driven longitudinally in opposite directions against said structural members; and striking means associated with said lances intermediate the ends thereof and adjacent the hole in the wall member adapted to receive a longitudinally directed blow through the hole in the wall from a striking tool and drive each of said member engaging means independently of the other into engagement with said structural members.

* * * * *